United States Patent [19]

de Vries

[11] 4,189,142

[45] Feb. 19, 1980

[54] TENNIS RACKET

[76] Inventor: Robert de Vries, The Hague, Netherlands

[21] Appl. No.: 808,921

[22] Filed: Jun. 22, 1977

[30] Foreign Application Priority Data

May 13, 1977 [NL] Netherlands ..... 7705313

[51] Int. Cl.[2] ..... A63B 51/06

[52] U.S. Cl. ..... 273/73 D

[58] Field of Search ..... 273/29 A, 67 R, 67 B, 273/73 R, 73 C, 73 D, 73 E, 73 F, 73 H, 73 L, 76, 78, 173, 26 A

[56] References Cited

U.S. PATENT DOCUMENTS

| | | | |
|---|---|---|---|
| 3,162,443 | 12/1964 | Petri | 273/73 R |
| 3,834,699 | 9/1974 | Pass | 273/73 D |
| 3,904,202 | 9/1975 | DeLorean | 273/73 E |
| 3,968,966 | 7/1976 | D'Aguanni | 273/73 D |
| 4,079,935 | 3/1978 | Gormley | 273/67 R |

FOREIGN PATENT DOCUMENTS

| | | | |
|---|---|---|---|
| 203921 | 6/1959 | Fed. Rep. of Germany | 273/73 R |
| 2143255 | 4/1973 | Fed. Rep. of Germany | 273/73 D |
| 395001 | 12/1908 | France | 273/73 D |
| 24856 | of 1913 | United Kingdom | 273/73 D |
| 1051041 | 12/1966 | United Kingdom | 273/67 D |

*Primary Examiner*—Richard J. Apley
*Attorney, Agent, or Firm*—Lester Horwitz

[57] ABSTRACT

A tennis racket comprising a frame having two spaced apart peripheral rows of threading openings for two spaced apart string cord layers, and an intermediate flexible layer in at least the central interspace area between said two string cord layers to interconnect said two string cord layers.

6 Claims, 6 Drawing Figures

FIG. 1
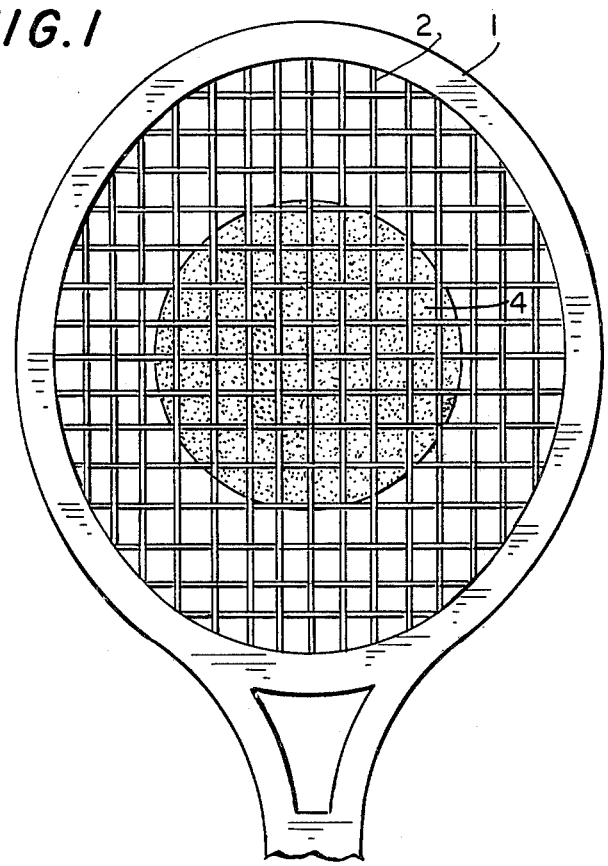
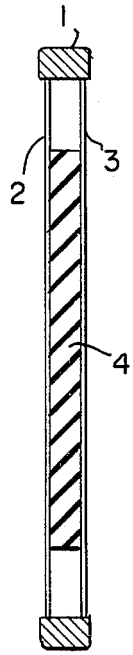
FIG. 2
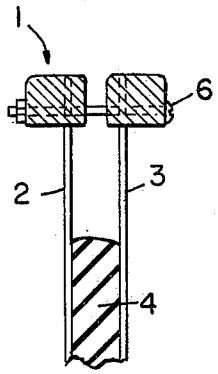
FIG. 4
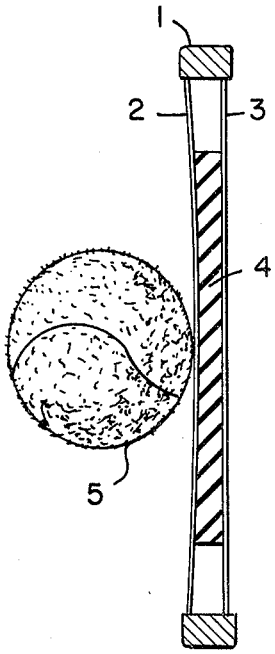
FIG. 3A
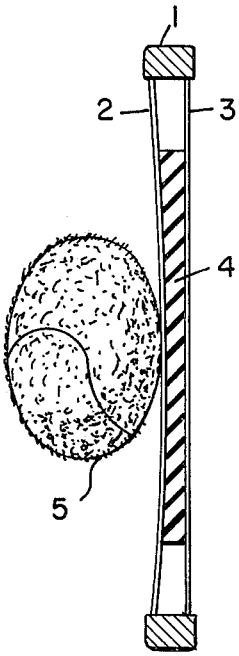
FIG. 3B
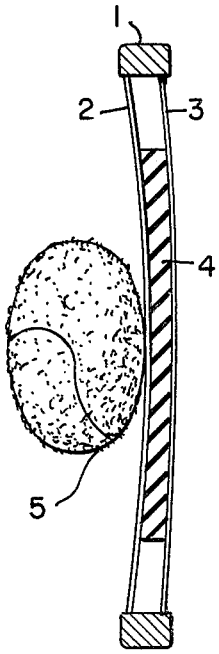
FIG. 3C

TENNIS RACKET

BACKGROUND OF THE INVENTION

This invention relates to a tennis racket.

The prior art relates to tennis rackets having a single string cord layer or comprise two spaced apart string cord layers which act individually when striking a ball as shown in U.S. Pat. No. 3,904,202. A ball bouncing from it can get a speed of about sixty miles per hour.

SUMMARY OF THE INVENTION

The object of the present invention is to provide a racket which can give a tennis ball an even greater speed. This new tennis racket is provided with at least two string cord layers and a flexible intermediate layer extending over at least the central area of the string cord layers to interconnect the string cord layers.

The strike takes place in three stages. In the first stage the string cord layer which hits the ball bounces inward. As second stage the intermediate layer bounces inward. In the third stage the opposite string cord layer also bounces up.

Bouncing back takes place in reverse order of the stages, upon which the ball leaves the racket at a great speed.

The preferred embodiment of the racket according to the invention is characterized by a flexible intermediate layer of rubber or synthetic material, in the interspace between the string cord layers, of a thickness in the order of some millimeters to some centimeters, and further by frame halves consisting of identical frames with cord stringing, secured on each other, with an intermediate layer between the string cord layers, said frame halves being secured on each other in an adjustable manner for precompressing the intermediate layer.

The invention is described in more detail in the following specification with reference to the drawing, in which the invention is illustrated.

BRIEF DESCRIPTION OF THE DRAWING

FIG. 1 is a plan view of the head of the racket showing the flexible intermediate layer FIG. 2 is a sectional view, at a reduced scale, of a racket frame having twin cord stringing, with a flexible intermediate layer;

FIGS. 3*a–c* show the three bouncing stages of the respective string cord layers and the flexible intermediate layer when striking a ball; and FIG. 4 is a broken-away sectional view, at a somewhat larger scale, of frame halves which are secured on each other in an adjustable manner for precompressing the flexible intermediate layer.

DESCRIPTION OF THE PREFERRED EMBODIMENT

FIG. 2 shows a section of a racket frame 1 with two identical string cord layers 2,3. The racket frame as shown is composed of two identical halves which are cemented on each other, and are each provided with a cord stringing. Between the string cord layers 2,3 a flexible intermediate layer 4 of rubber or synthetic material is disposed, which provides the interconnection between the string cord layers.

FIG. 3*a* shows the first string cord layer 2 bouncing inward at the first stage when hitting the ball 5.

FIG. 3*b* represents the second stage when also the flexible intermediate layer 4 resiliently bounces inward.

FIG. 3*c* shows the third and final stage when the second string cord layer 3 also bounces up.

Bouncing back takes place reversely from the third, through the second, back to the first stage.

Striking a ball back, and also serving, happens in a forceful and rapid manner with the new racket. This effect is to be enhanced by precompressing the flexible intermediate layer 4 by securing frame halves by means of adjustable screws 6 as illustrated in FIG. 3 by arrows.

Having thus described my invention, what I claim is:

1. A tennis racket comprising a frame having two spaced apart peripheral rows of threading openings for two spaced apart string cord layers in conventional basket weave pattern, and an intermediate layer of a flexible material in at least the central interspace area between said two string cord layers to interconnect said two string cord layers.

2. A tennis racket according to claim 1 in which said intermediate layer is natural or synthetic rubber.

3. A tennis racket comprising a frame of identical frame halves, each with a peripheral row of lacing openings for a string cord layer in a conventional basket weave pattern, with an intermediate layer of a flexible material in at least the central interspace area between said two string cord layers to interconnect said two string cord layers.

4. A tennis racket according to claim 3 in which said frame halves are secured to each other in an adjustable manner for precompressing said intermediate flexible layer.

5. A tennis racket according to claim 3 in which said intermediate layer is natural or synthetic rubber.

6. A tennis racket according to claim 5 in which said frame halves are secured to each other in an adjustable manner for precompressing said intermediate flexible layer.

* * * * *